US007339855B2

(12) United States Patent
Muraji

(10) Patent No.: US 7,339,855 B2
(45) Date of Patent: Mar. 4, 2008

(54) TIMEPIECE

(75) Inventor: Toyonori Muraji, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 0 days.

(21) Appl. No.: 11/806,815

(22) Filed: Jun. 4, 2007

(65) Prior Publication Data

US 2007/0280055 A1 Dec. 6, 2007

(30) Foreign Application Priority Data

Jun. 5, 2006 (JP) ..... 2006-156629

(51) Int. Cl.

| | |
|---|---|
| ***G04B 19/00*** | (2006.01) |
| ***G04B 19/04*** | (2006.01) |
| ***G04B 19/06*** | (2006.01) |
| ***G04B 25/06*** | (2006.01) |
| ***G04B 17/00*** | (2006.01) |

(52) U.S. Cl. ..... 368/223; 368/228; 368/229; 368/285

(58) Field of Classification Search ..... 368/75, 368/88, 223, 228, 229, 232, 244, 272–273, 368/285

See application file for complete search history.

(56) References Cited

U.S. PATENT DOCUMENTS 3,444,685 A * 5/1969 Juillerat ..... 368/276
4,941,137 A * 7/1990 Kikuchi ..... 368/223
4,993,006 A * 2/1991 Oshima et al. ..... 368/231
5,047,998 A * 9/1991 Aizawa et al. ..... 368/75
5,124,959 A * 6/1992 Yamazaki et al. ..... 368/231
5,161,130 A * 11/1992 Sato et al. ..... 368/228
6,229,768 B1 * 5/2001 Nakazawa et al. ..... 368/223

FOREIGN PATENT DOCUMENTS

JP B2-2585944 2/1997

* cited by examiner

*Primary Examiner*—Vit Miska
(74) *Attorney, Agent, or Firm*—Oliff & Berridge, PLC.

(57) ABSTRACT

A mechanical timepiece has an ornamental portion and a plurality of movable units operable to expose and hide the ornamental portion. Each of the movable units includes a divisional segment for exposing and hiding the ornamental portion by inward and outward movement, a holding plate configured to hold the divisional segment in a movable manner so as to move the divisional segment in inward and outward directions, and an attachment structure for attaching the divisional segment to the holding plate. The attachment structure is formed integrally with at least one of the holding plate and the divisional segment. The attachment structure includes engagement portions projecting from both sides of the holding plate and a pair of holder members formed on a surface of the divisional segment so as to have an L-shaped cross-section with their tip portions being opposed to each other. The pair of holder members extends in a predetermined direction so as to sandwich peripheral surfaces of the engagement portions therebetween.

6 Claims, 16 Drawing Sheets

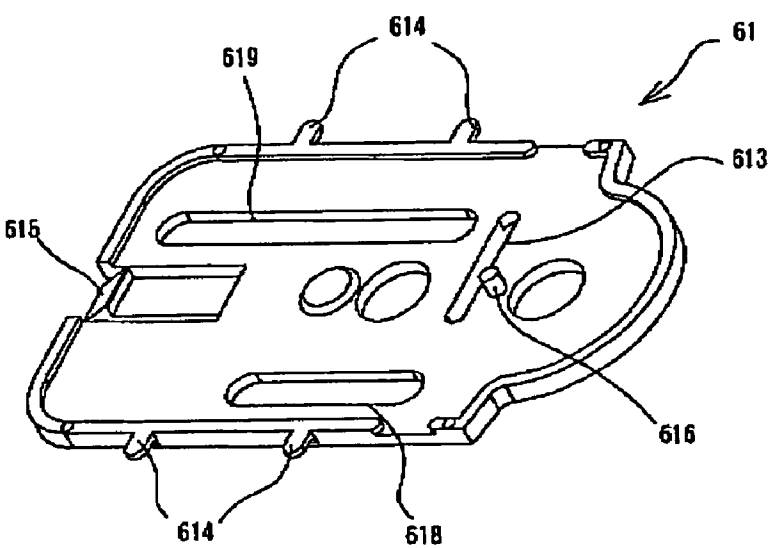
FIG. 11D
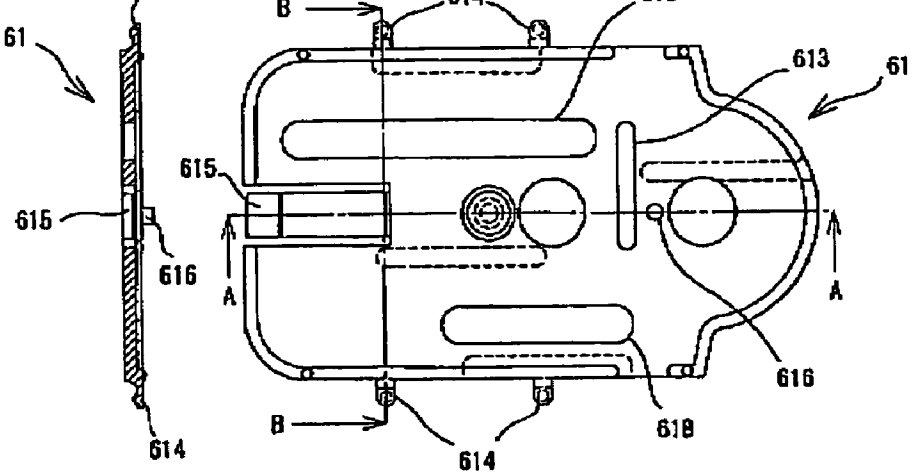
FIG. 11A
FIG. 11C
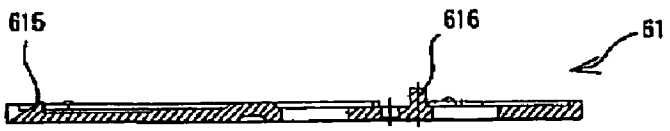
FIG. 11B

TIMEPIECE

BACKGROUND OF THE INVENTION

1. Field of the Invention

The present invention relates to a timepiece, and more particularly, to a mechanical timepiece such as a marionette clock.

2. Description of the Related Art

With Heretofore, there has been known a mechanical clock having movable dials THAT are moved, for example, on the hour so as to expose ornamental members located behind the movable dials (see Japanese Patent No. 2585944).

The mechanical clock disclosed by Japanese Patent No. 2585944 has a guide mechanism for guiding and supporting the movable dials in a movable manner. This guide mechanism includes a pair of guide ribs projecting on a support plate, sliders attached to the movable dials so as to be slidable on guide surfaces of the guide ribs, and spring members for pressing the sliders against the guide surfaces of the guide ribs.

However, in order to prevent looseness between the movable dials and the guide ribs, the movable dials to which the sliders are attached should be arranged so as to slide on the guide surfaces of the guide ribs, and then the spring members should be attached to the support plate so as to press the sliders. Thus, the aforementioned guide mechanism requires a complicated assembly process for attachment of the movable dials.

SUMMARY OF THE INVENTION

It is, therefore, an object of the present invention to provide a mechanical timepiece that can readily be assembled.

The above object is attained by a mechanical timepiece having an ornamental portion and a plurality of movable units operable to expose and hide the ornamental portion. Each of the movable units includes a divisional segment for exposing and hiding the ornamental portion by inward and outward movement, a holding plate configured to hold the divisional segment in a movable manner so as to move the divisional segment in inward and outward directions, and an attachment structure for attaching the divisional segment to the holding plate. The attachment structure is formed integrally with at least one of the holding plate and the divisional segment. The attachment structure includes engagement portions projecting from both sides of the holding plate and a pair of holder members formed on a surface of the divisional segment so as to have an L-shaped cross-section with their tip portions being opposed to each other. The pair of holder members extends in a predetermined direction so as to sandwich peripheral surfaces of the engagement portions therebetween.

With the above arrangement, the attachment structure for attachment of the divisional segment to the holding plate is formed integrally with at least one of the holding plate and the divisional segment. Accordingly, no separate members are needed to attach the divisional segment to the holding plate. As a result, the number of parts can be reduced, and the divisional segment can readily be attached to the holding plate. Thus, the mechanical timepiece can readily be assembled.

Additionally, a pair of holder members having an L-shaped cross-section is formed so as to surround peripheral surfaces of the engagement portions. Accordingly, looseness between the holding plate and the divisional segment can be prevented in a vertical direction and a direction in which the engagement portions extend. Thus, it is possible to maintain an accuracy of attachment of the divisional segment to the holding plate.

Furthermore, the pair of holder members may have notch portions for allowing the engagement portions to pass therethrough from between the pair of holder members so as to detach the divisional segment from the holding plate. The divisional segment may be attached to the holding plate by pushing the holding plate or the divisional segment so that the engagement portions inserted between the pair of holder members are moved toward retraction positions away from the notch portions. With this arrangement, the divisional segment can readily be detached from the holding plate.

Moreover, the attachment structure may further include a stopper configured to regulate a relative movement between the holding plate and the divisional segment in a regulation direction from the retraction positions to the notch portions so as to prevent detachment of the engagement portions from the notch portions after the divisional segment has been attached to the holding plate. With this arrangement, it is possible to the divisional segment from being detached from the holding plate after the divisional segment has been attached to the holding plate.

Furthermore, each of the plurality of movable units may further include a biasing member configured to bias at least one of the holding plate and the divisional segment in the regulation direction so as to regulate a relative movement between the holing plate and the divisional segment in a direction opposite to the regulation direction. With this arrangement, it is possible to regulate a relative movement in the direction opposite to the regulation direction. Accordingly, the divisional segment can reliably be positioned with respect to the holding plate.

Moreover, the attachment structure may have a clearance between a stop position of the divisional segment to a stop position of the holding plate for allowing a relative movement between the holding plate and the divisional segment when the divisional segment is moved. Each of the movable units may further include a biasing member configured to bias the divisional segment in a direction opposite to a direction in which the divisional segment is moved in a state such that the holding plate is fixed.

With this arrangement, the divisional segments are further biased in the direction opposite to their movement directions in a state in which they are at closed positions. Accordingly, gaps are prevented from being produced between the adjacent divisional segments when the divisional segments are at the closed positions. Thus, it is possible to reliably hold the divisional segments in a closed state.

In this case, the biasing member may also serve to bias at least one of the holding plate and the divisional segment in the regulation direction so as to regulate a relative movement between the holing plate and the divisional segment in a direction opposite to the regulation direction. With this arrangement, it is possible to simplify parts required for a mechanical timepiece.

According to the present invention, it is possible to provide a mechanical timepiece which can readily be assembled.

The above and other objects, features, and advantages of the present invention will be apparent from the following description when taken in conjunction with the accompanying drawings which illustrate preferred embodiments of the present invention by way of example.

BRIEF DESCRIPTION OF THE DRAWINGS

FIGS. 11A to 11D are views showing an arrangement of a slide plate in the driving mechanism shown in FIG. 8;

DETAILED DESCRIPTION OF THE PREFERRED EMBODIMENTS

A mechanical timepiece according to an embodiment of the present invention will be described below with reference to FIGS. 1 to 15. In the following embodiment, the mechanical timepiece is represented as a mechanical clock. However, the present invention is applicable to any type of mechanical timepieces.

Figure 1:
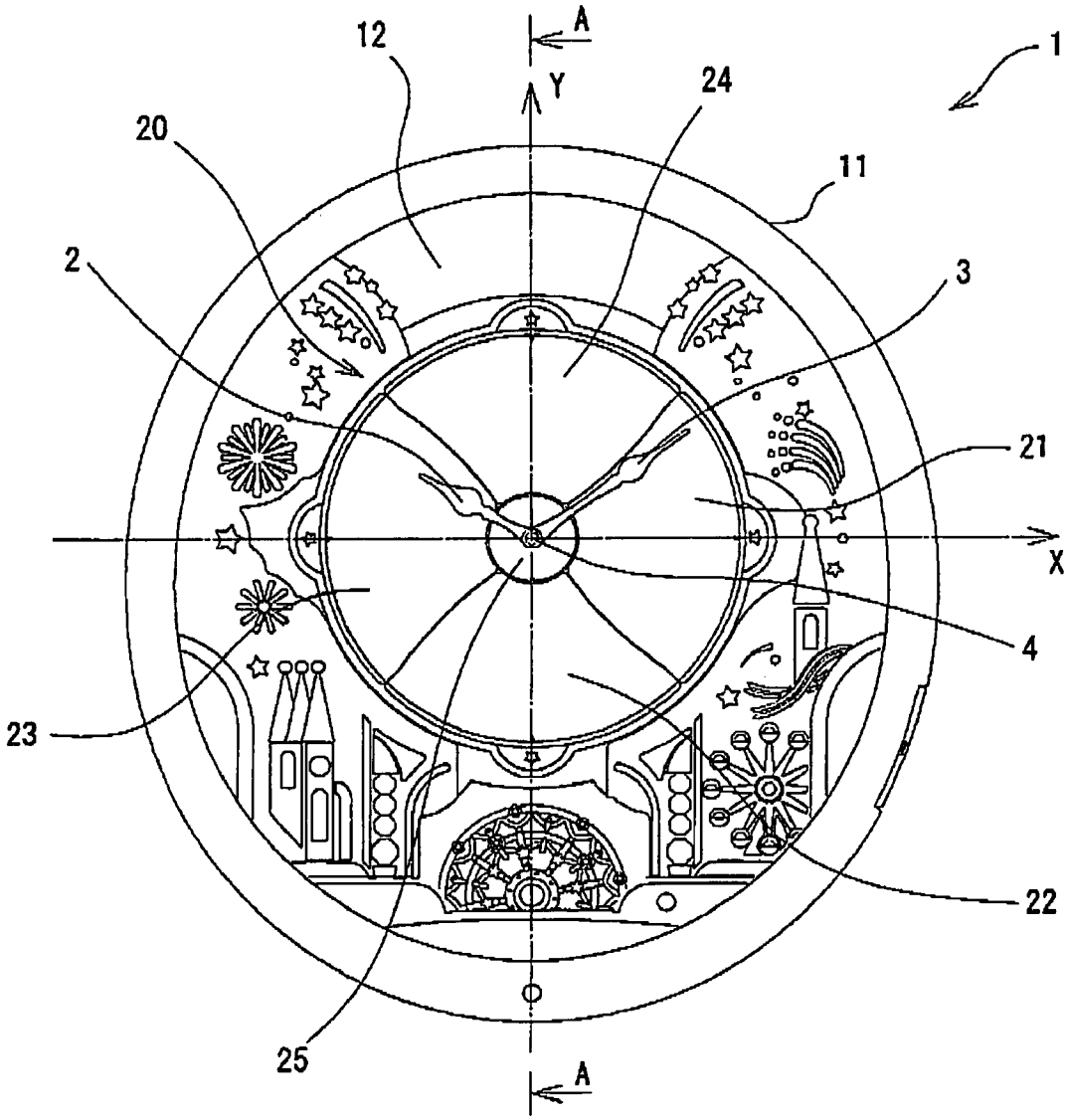
FIG. 1 is a front view showing a mechanical timepiece (mechanical clock) according to an embodiment of the present invention.
Figure 2:
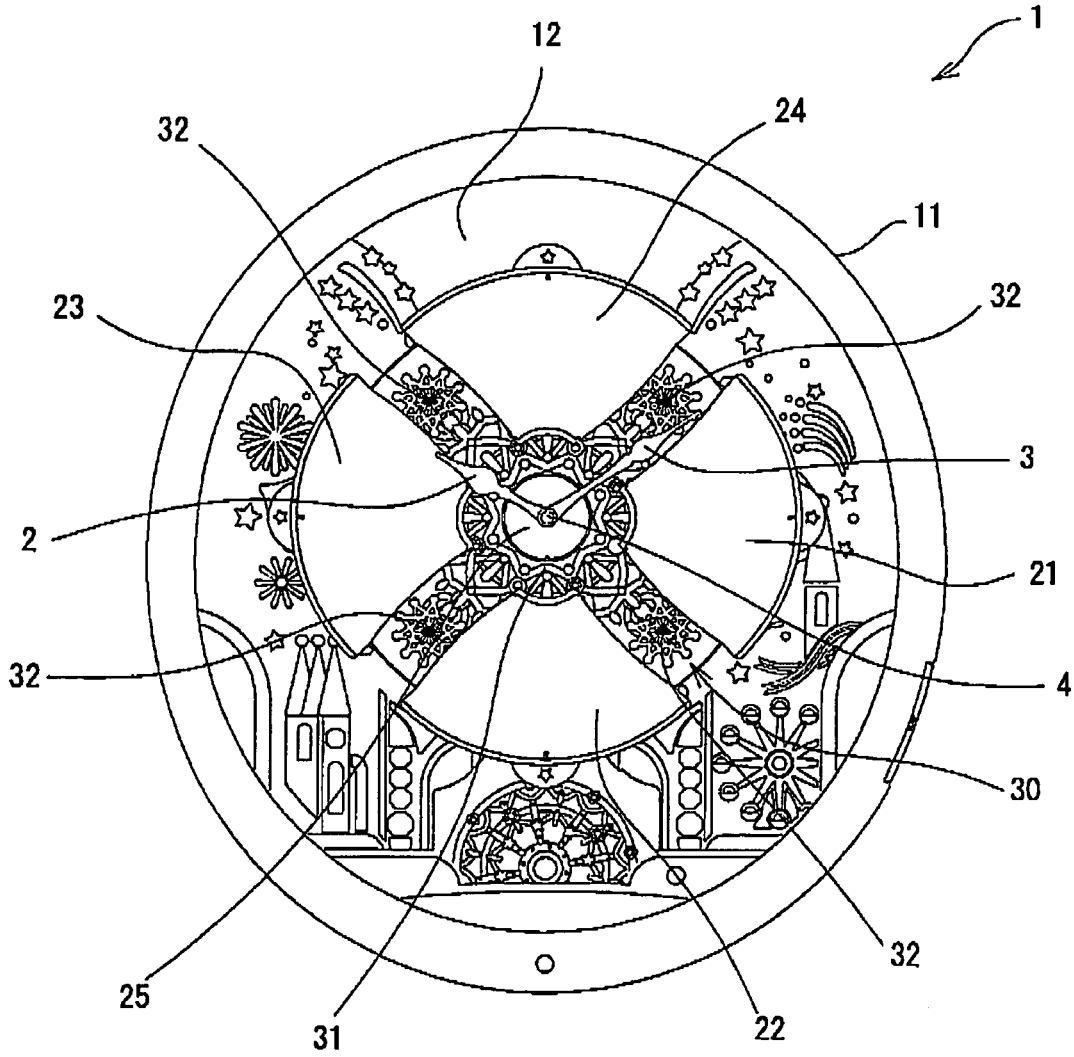
FIG. 2 is a front view showing that ornamental members are partially exposed when movable divisional segments are moved outward.
Figure 3:
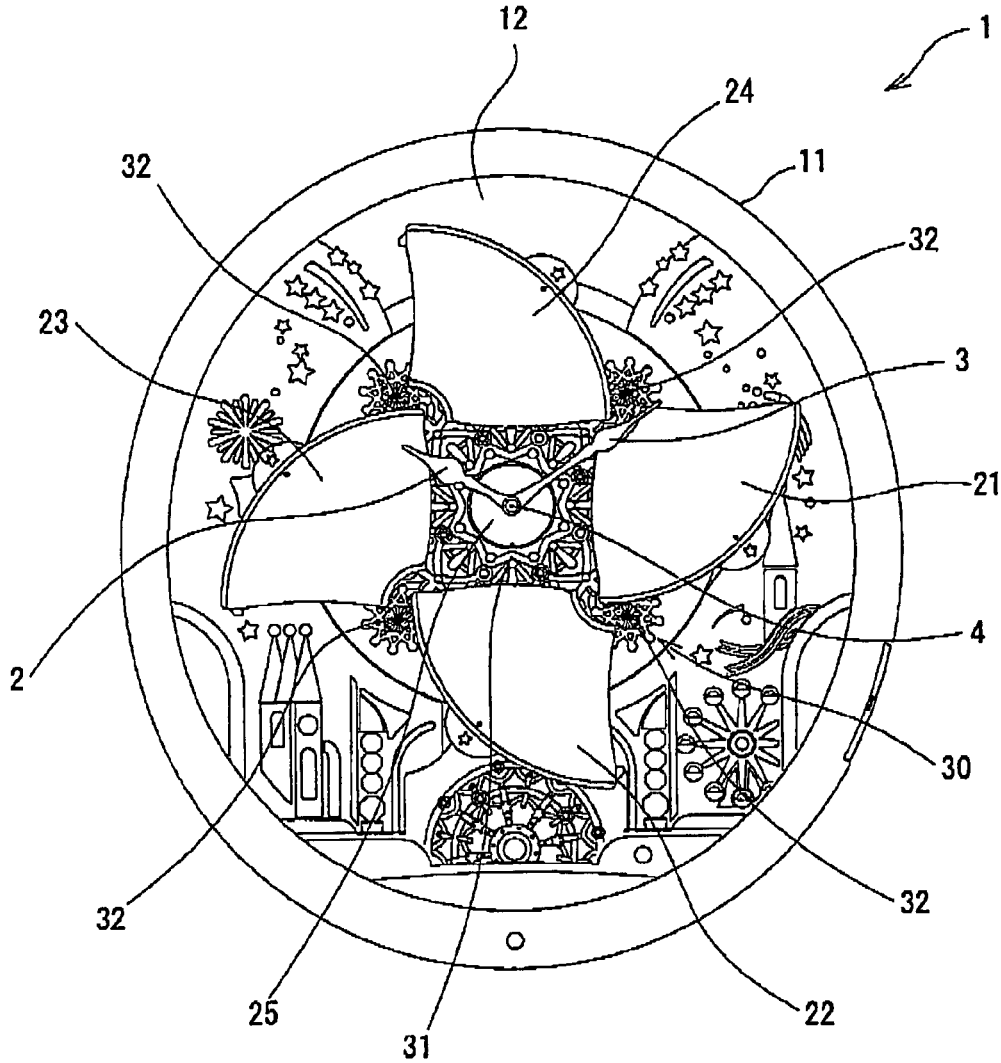
FIG. 3 is a front view showing that the movable divisional segments moved outward are rotated about their axes through 45°.
Figure 4:
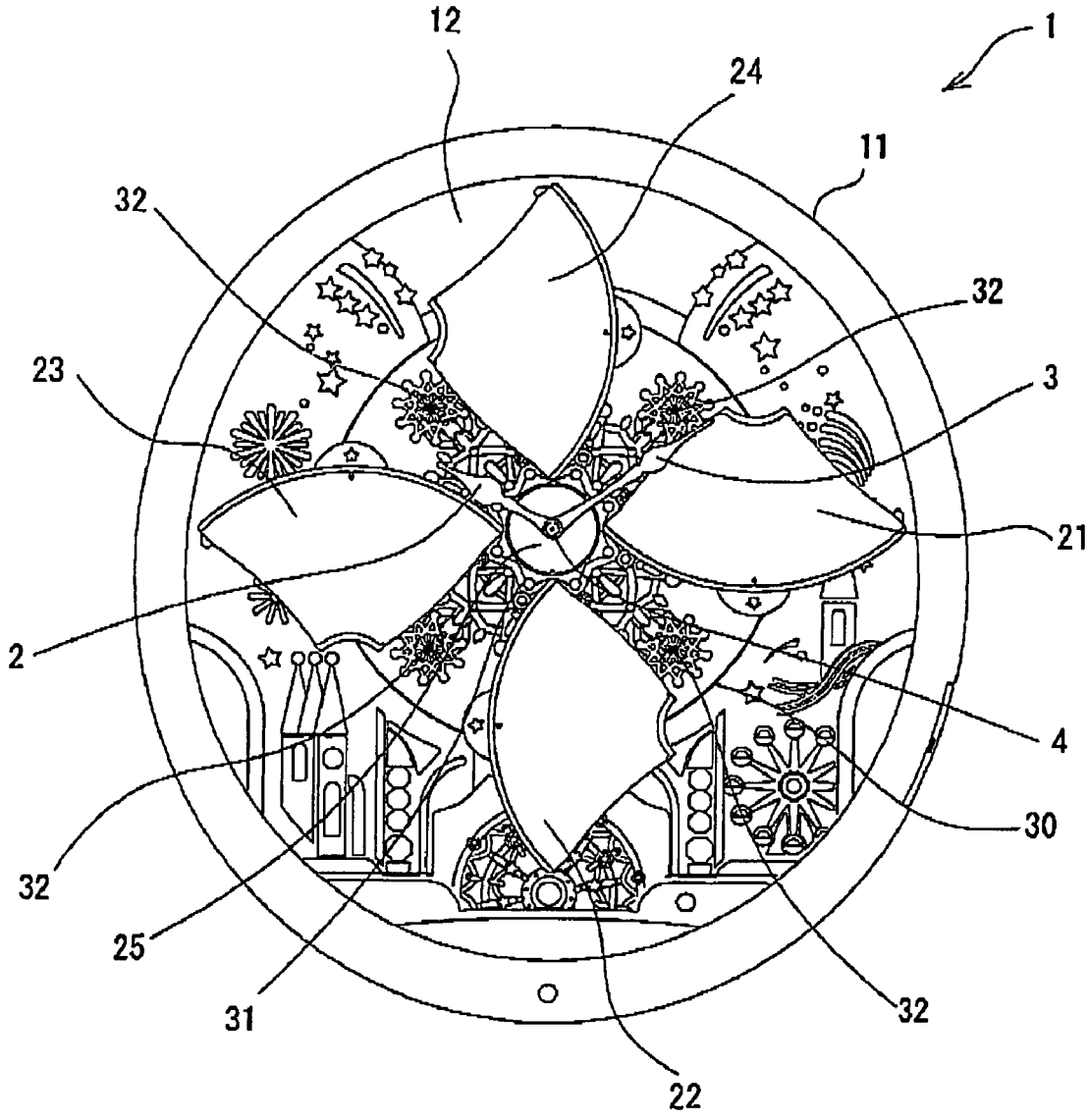
FIG. 4 is a front view showing that the movable divisional segments moved outward are rotated about their axes through 90°.
Figure 5:
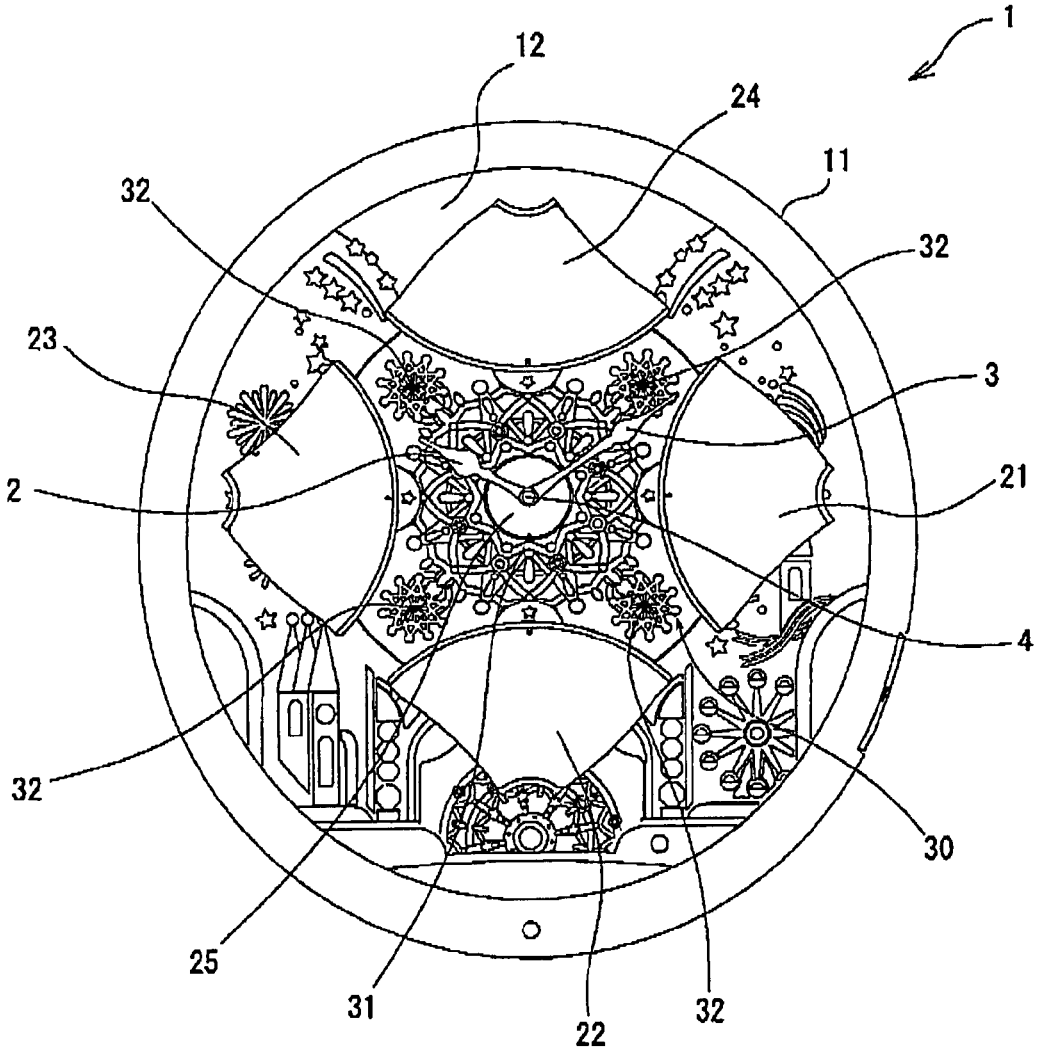
FIG. 5 is a front view showing that the movable divisional segments moved outward are rotated about their axes through 180°.
Figure 6:
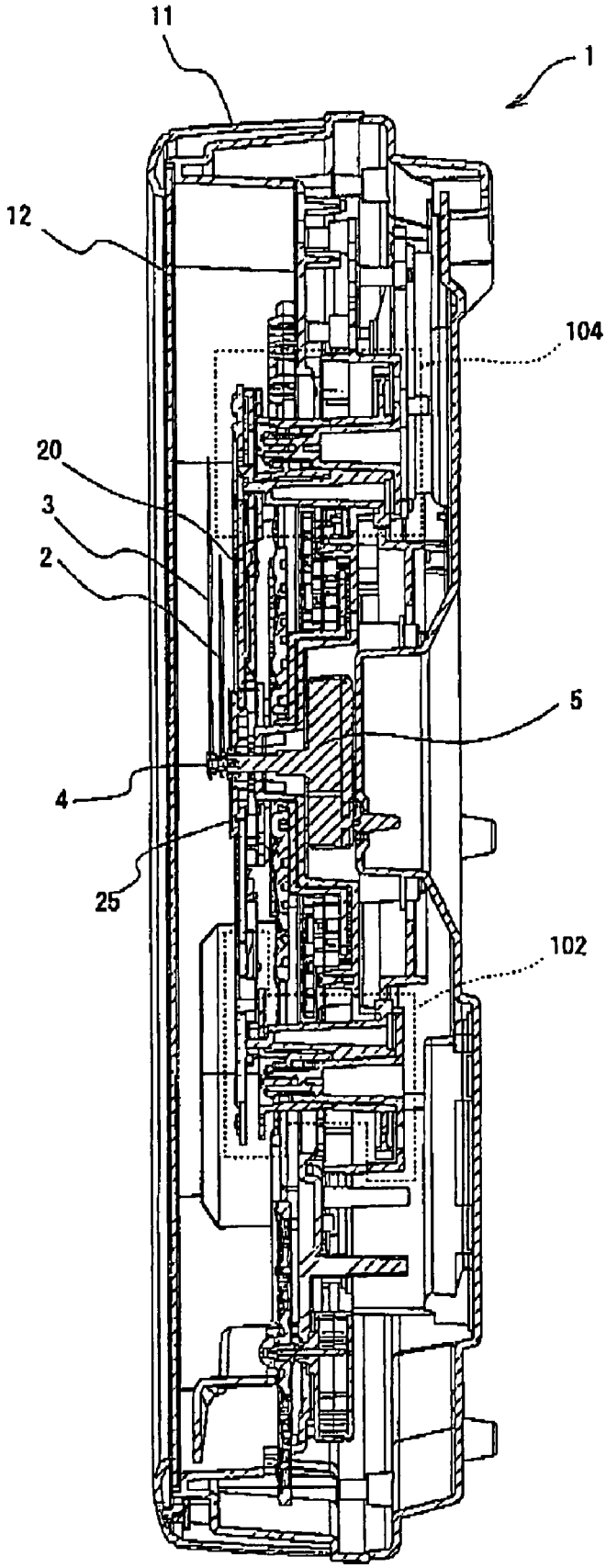
FIG. 6 is a cross-sectional view taken along line A-A of FIG. 1.

FIGS. 1 to 5 show a marionette clock that is one of the mechanical clocks according to an embodiment of the present invention. FIG. 1 is a front view of the mechanical clock. FIG. 2 is a front view showing that ornamental members are partially exposed when movable divisional segments are moved outward as described later. FIG. 3 is a front view showing that the movable divisional segments moved outward are rotated about their axes through 45°. FIG. 4 is a front view showing that the movable divisional segments moved outward are rotated about their axes through 90°. FIG. 5 is a front view showing that the movable divisional segments moved outward are rotated about their axes through 180°. FIG. 6 is a cross-sectional view taken along line A-A of FIG. 1.

The mechanical clock 1 in the present embodiment includes a frame 11 defining an outer edge of the clock 1, a glass 12 covering the front of the frame 11, a hour hand 2 and a minute hand 3 for representing the present time, a rotation shaft 4 for the hour hand 2 and the minute hand 3, a movement 5 for driving the hour hand 2, the minute hand 3, and the like, a circular dial 20, an ornamental portion 30 located behind the circular dial 20, and driving mechanisms 101 to 104 located behind the ornamental portion 30. The circular dial 20 is divided into four movable divisional segments (a plurality of divisional segments) 21 to 24 each having a sectorial shape and a fixed divisional segment 25 having a circular shape. The movable divisional segments are radially divided at equal angles. The fixed divisional segment 25 is disposed around the rotation shaft 4. The ornamental portion 30 is exposed when the movable divisional segments 21 to 24 are moved outward and rotated. The driving mechanisms 101 to 104 are operable to move the movable divisional segments 21 to 24 in inward and outward directions and rotate them about their axes. The ornamental portion 30 is exposed and hidden by the outward movement of the movable divisional segments 21 to 24.

The ornamental portion 30 includes a first ornamental member 31 disposed so as to surround the rotation shaft 4 and second ornamental members 32 arranged at equal angles of 90° around the first ornamental member 31.

FIG. 6 shows only two driving mechanisms 102 and 104 operable to drive the movable divisional segments 22 and 24, respectively. Furthermore, numerals printed on the dial 20 are not illustrated in FIGS. 1 to 5.

As shown in FIG. 1, the movable divisional segments 21 to 24 are located at a closed position in a normal state so as not to expose the ornamental portion 30.

At a certain time, as shown in FIG. 2, the movable divisional segments 21 to 24 are moved radially on an X-Y plane that has a point of origin at the center of the rotation shaft 4 and is perpendicular to the rotation shaft 4, and thus separated from the fixed divisional segment 25. Specifically, the movable divisional segment 21 is moved in the rightward direction (X+) on the X-Y plane, and the movable divisional segment 22 is moved in the downward direction (Y−). The movable divisional segment 23 is moved in the leftward direction (X−), and the movable divisional segment 24 is moved in an upward direction (Y+). When the movable divisional segments 21 to 24 are moved outward to predetermined positions, only a portion of the ornamental portion 30 located behind the movable divisional segments 21 to 24 is exposed. More specifically, when the movable divisional segments 21 to 24 are moved radially outward, the first ornamental member 31 is partially exposed while the second ornamental members 32 are exposed between adjacent movable divisional segments. The first ornamental member 31 and the second ornamental members 32 are configured to rotate. Thus, the ornamental portion 30 is exposed approximately in the form of an X.

Then, when the movable divisional segments 21 to 24 are moved outward to the predetermined positions, they start to rotate clockwise about their axes at the predetermined positions. As shown in FIG. 3, when the movable divisional segments 21 to 24 are rotated clockwise through 45°, they are held such that an outer shape of the whole of the movable divisional segments 21 to 24 is in the form a windmill. Furthermore, the first ornamental member 31 is exposed approximately in the form of a square by the edges of the movable divisional segments 21 to 24 facing the fixed divisional segment 25.

Next, as shown in FIG. 4, the movable divisional segments 21 to 24 are moved outward and rotated clockwise about their axes through 90°. The movable divisional segments 21 and 23 are opposed to each other so as to face in different directions while the fixed divisional segment 25 is interposed between the movable divisional segments 21 and 23. The movable divisional segments 22 and 24 are also opposed to each other so as to face in different directions while the fixed divisional segment 25 is interposed between the movable divisional segments 22 and 24. At that time, the ornamental portion 30 is exposed approximately in the form of an X.

Then, as shown in FIG. 5, the movable divisional segments 21 to 24 are moved outward and rotated clockwise about their axes through 180°. The ornamental portion 30 is exposed to a large extent by this rotation. Thus, almost all areas of the first ornamental member 31 and the second ornamental members 32 are exposed. Furthermore, an outer shape of the whole of the movable divisional segments 21 to 24 is held in the form of a rhombus.

As described above, an exposure state of the ornamental portion 30 is changed by the movement and rotation of the movable divisional segments 21 to 24.

Now, the driving mechanisms for driving the movable divisional segments will be described.

Figure 7:
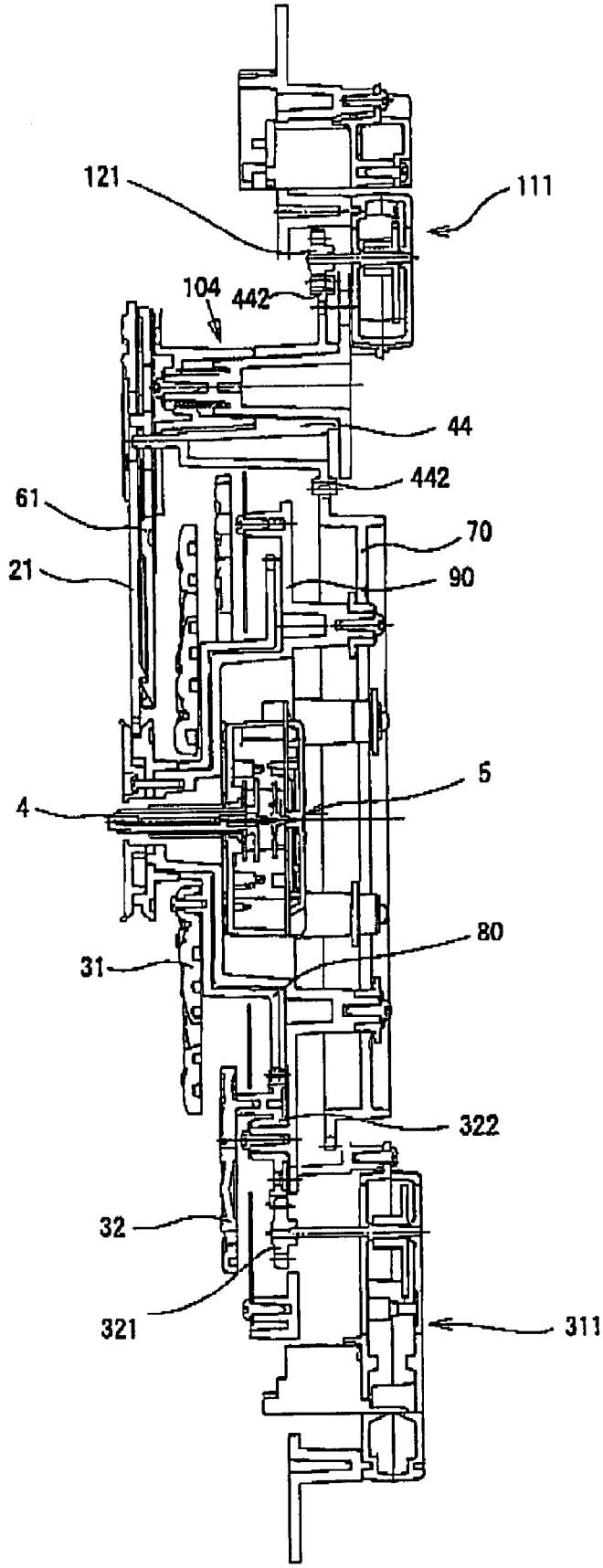
FIG. 7 is a cross-sectional view explanatory of driving rotation transmitted to one of driving mechanisms.

FIG. 7 is a cross-sectional view explanatory of driving rotation transmitted to the driving mechanism 104. As shown in FIG. 7, a dial motor block 111 is disposed behind the driving mechanism 104 for moving the movable divisional segments 21 to 24 in the inward and outward directions. The driving mechanism 104 includes a rotatable member 44 having a gear portion 442 formed on an outer circumferential surface of the rotatable member 44. The dial motor block 111 rotates a driving pinion 121 engaging with the gear portion 442 of the rotatable member 44. Thus, the rotatable member 44 is driven and rotated by the driving pinion 121. Furthermore, an idler gear 70 is disposed behind the movement 5 and the ornamental portion 30, and the gear portion 442 of the rotatable member 44 engages with the idler gear 70. Accordingly, the idler gear 70 is driven and rotated by the rotatable member 44 of the driving mechanism 104.

In addition to the rotatable member 44, other rotatable members are provided around the idler gear 70 in the driving mechanisms for driving the movable divisional segments 21 to 23. Although not shown in FIG. 7, the idler gear 70 engages with gear portions formed on outer circumferential surfaces of the rotatable members provided in the driving mechanisms for driving the movable divisional segments 21 to 23. Those rotatable members are driven and rotated by rotation of the idler gear 70.

In this manner, the driving rotation of the dial motor block 111 is transmitted to the rotatable member 44 of the driving mechanism 104, then transmitted from the rotatable member 44 to the idler gear 70, and transmitted from the idler gear 70 to the rotatable members provided in the driving mechanisms for driving the movable divisional segments 21 to 23. With this configuration, a plurality of movable divisional segments can be driven by a single driving source.

As shown in FIG. 7, an ornamental member motor block 311 is disposed behind the ornamental portion 30 for driving the ornamental portion 30. The ornamental member motor block 311 rotates a driving pinion 321, which engages with a gear 322 for the second ornamental member 32. The gear 322 is coupled to the second ornamental member 32. Accordingly, the second ornamental member 32 is rotated in cooperation with rotation of the gear 322. Furthermore, the gear 322 for the second ornamental member 32 is rotatable about the rotation shaft 4 and engages with a gear 80 for the first ornamental member 31. The gear 80 has an upper surface to which the first ornamental member 31 is fixed. Thus, the gear 80 for the first ornamental member 31 is driven and rotated by the gear 322 for the second ornamental member 32. Furthermore, the gear 80 for the first ornamental member 31 engages with gears for driving the other second ornamental members.

In this manner, the driving rotation of the ornamental member motor block 311 is transmitted to the gear 322 for the second ornamental member 32, then transmitted from the gear 322 to the gear 80 for the first ornamental member 31, and transmitted from the gear 80 to the gears for the other ornamental members. With this configuration, a plurality of ornamental members can be driven by a single driving source.

Next, the driving mechanisms for moving the movable divisional segments in the inward and outward directions and rotating them about their axes will be described in greater detail.

Figure 8:
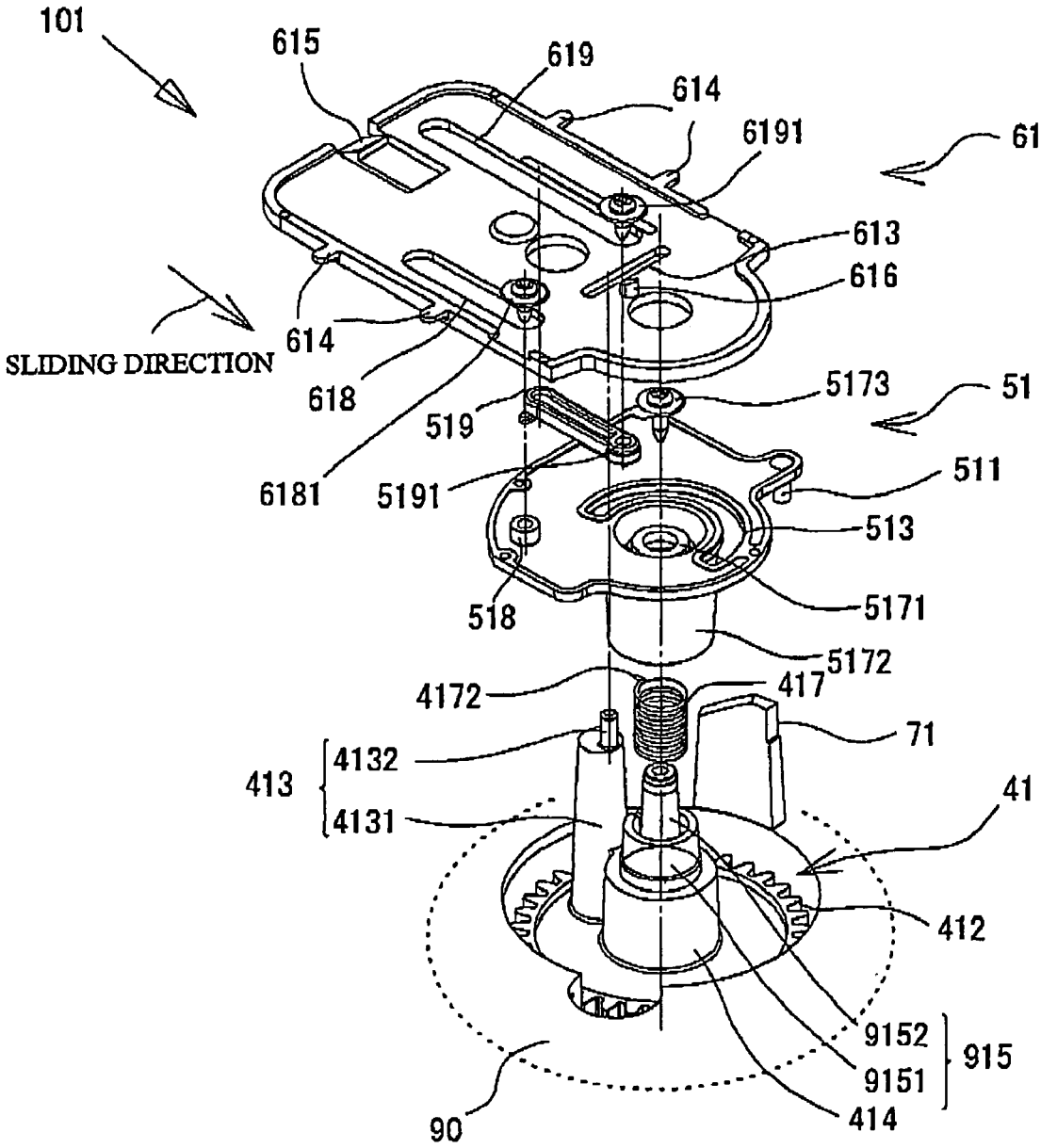
FIG. 8 is an exploded perspective view showing one of the driving mechanisms.

FIG. 8 is an exploded perspective view showing one of the driving mechanisms. The driving mechanism shown in FIG. 8 serves to move the movable divisional segment 21 in the inward and outward directions and rotate it about its axis.

Figure 9A:
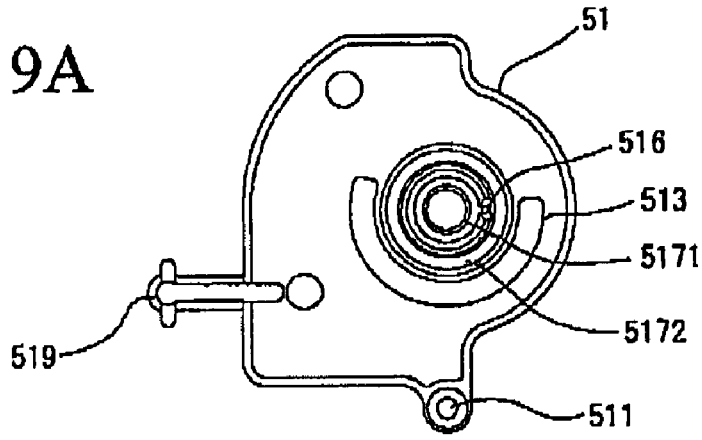
FIGS. 9A to 9D are views showing an arrangement of a rotatable member and a rotatable stage in the driving mechanism shown in FIG. 8.

FIGS. 9A to 9D are views showing an arrangement of a rotatable member and a rotatable stage in the driving mechanism shown in FIG. 8. FIG. 9A is a bottom view of the rotatable stage, FIG. 9B a top view of the rotatable stage attached to the rotatable member, FIG. 9C a cross-sectional view taken along line A-A of FIGS. 9B, and 9D a view showing a position of a slit defined in a rotation shaft of a base plate.

As shown in FIG. 8, the driving mechanism 101 includes a rotatable member 41, a rotatable stage 51, and a slide plate 61.

First, the rotatable member 41 will be described. As shown in FIGS. 8 and 9C, the rotatable member 41 is held so as to be rotatable about a fixed shaft 915 formed on a base plate 90. The rotatable member 41 is received in a recessed portion formed in the base plate 90.

As described above, the rotatable member 41 has a gear portion 412 formed on an outer circumferential surface thereof. The gear portion 412 engages with the idler gear 70.

The rotatable member 41 also includes an output pin 413 for outputting driving rotation from the dial motor block 111. The output pin 413 is integrally formed at a position deviated from the center of rotation. The output pin 413 extends perpendicular to a rotation direction of the rotatable member 41 and includes a body portion 4131 and a tip portion 4132 extending from the body portion 4131. The tip portion 4132 has a diameter smaller than that of the body portion 4131.

Furthermore, the rotatable member 41 has a bearing holder 414, which is brought into sliding contact with the rotatable stage 51.

The fixed shaft 915 includes a body portion 9151 and a tip portion 9152 extending with a diameter smaller than that of the body portion 9151. The fixed shaft 915 has a space defined in a radial direction between the body portion 9151 and the tip portion 9152 for receiving a torsion spring 417. The torsion spring 417 is received so as to wind around the tip portion 9152. As shown in FIGS. 9C and 9D, the body portion 9151 has a slit 916 defined therein for holding a lower end 4171 of the torsion spring 417 near the rotatable member 41.

Next, the rotatable stage 51 will be described.

The rotatable stage 51 has a through-hole 5171 defined therein, through which the tip portion 9152 of the fixed shaft 915 extends. The tip portion 9152 of the fixed shaft 915 has a thread groove formed therein. While the tip portion 9152 of the fixed shaft 915 penetrates the through-hole 5171, the rotatable stage 51 is held so as to be slidable with respect to the fixed shaft 915 by fitting a screw 5173 into the thread groove of the tip portion 9152.

Furthermore, the rotatable stage 51 includes a cylindrical leg portion 5172 extending in a direction facing to the rotatable member 41. The leg portion 5172 is formed so as to surround the tip portion 9152 and the body portion 9151 of the fixed shaft 915. The leg portion 5172 is brought into sliding contact with the bearing holder 414 of the rotatable member 41. Thus, the rotatable stage 51 is held such that it is maintained at a predetermined height with respect to the rotatable member 41 and can be rotated concentrically with the rotatable member 41.

The rotatable stage 51 has an arcuate groove 513 having a length of a semi-circle. The arcuate groove 513 is formed around the through-hole 5171. The tip portion 4132 of the output pin 413 engages with the arcuate groove 513. Furthermore, the arcuate groove 513 is formed along a predetermined range of a path of the output pin 413 moving in accordance with rotation of the rotatable member 41.

Figure 9B:
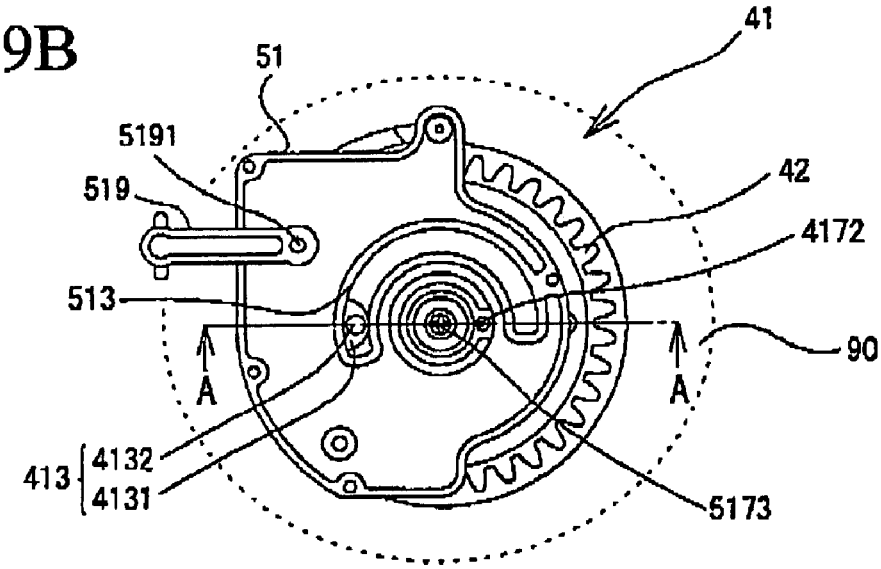
Figure 9C:
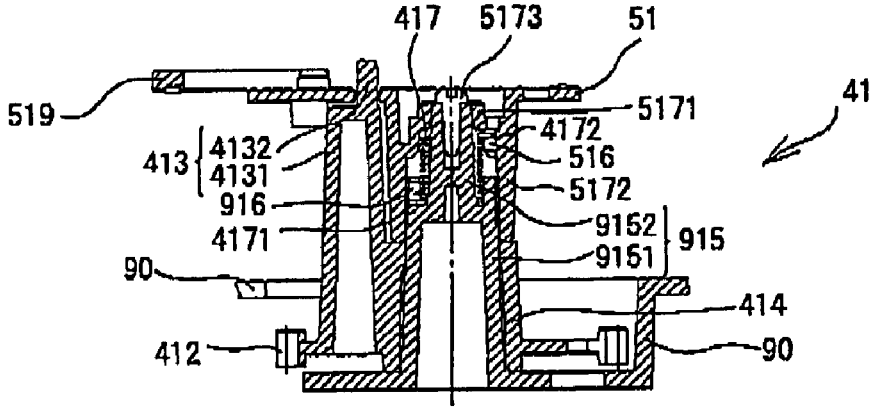
Figure 9D:
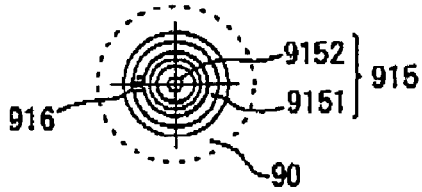

As shown in FIGS. 9A to 9C, the rotatable stage 51 has a slit 516 formed on an inner circumferential surface of the leg portion 5172 for holding an upper end 4172 of the torsion spring 417 near the rotatable stage 51. As shown in FIG. 9C, the slit 516 formed in the rotatable stage 51 and the slit 916 formed in the fixed shaft 915 are positioned with an angle of 180° formed therebetween. The torsion spring 417 is arranged such that both ends of the torsion spring 417 are aligned with the same direction at the natural state. When the torsion spring 417 is fitted into the slits 516 and 916, it is biased toward a direction opposite to the rotation direction of the rotatable stage 51 (clockwise in FIG. 9B), in which rotation is transmitted from the output pin 413. That is, the torsion spring 417 is placed such that the upper end 4172 of the torsion spring 417 is twisted clockwise.

Accordingly, even if the output pin 413 is moved clockwise within the arcuate groove 513, the biasing force allows only the rotatable member 41 to be rotated relative to the rotatable stage 51 with sliding contact between the leg portion 5172 and the bearing holder 414 while the rotatable stage 51 is stationary with respect to the fixed shaft 915.

When the rotatable member 41 is further rotated in a state such that the output pin 413 has been positioned to an end of the arcuate groove 513 by moving the output pin 413 beyond the predetermined range, the rotatable stage 51 starts to rotate in cooperation with the rotatable member 41, the details of which will be described later.

Furthermore, the rotatable stage 51 has a positional regulation pin 511 projecting toward the base plate 90. The base plate 90 has a positional regulation block 71 extending toward the rotatable stage 51. The rotation angle of the rotatable stage 51 is regulated by engagement of the positional regulation pin 511 with the positional regulation block 71. The rotatable stage 51 is biased in one direction by the torsion spring 417. Accordingly, the positional regulation pin 511 is brought into contact with the positional regulation block 71 by the bias of the torsion spring 417. The rotatable stage 51 is located at an initial position when the positional regulation pin 511 is brought into contact with the positional regulation block 71. The arcuate groove 513 is formed slightly longer than needed for the initial position to ensure contact between the positional regulation pin 511 and the positional regulation block 71. Therefore, when the positional regulation pin 511 is brought into contact with the positional regulation block 71, a slight gap is formed between the output pin 413 and an end of the arcuate groove 513 at the initial position.

Furthermore, the rotatable stage 51 has a slide guide portion 518 formed on a surface of the rotatable stage 51 facing the slide plate 61 for guiding the slide plate 61 and a slide guide member 519 fixed to the rotatable stage 51.

Next, the slide plate 61 will be described. The slide plate 61 holds the movable divisional segment 21 in a movable manner so as to move the movable divisional segment 21 in inward and outward directions.

The slide plate 61 has a first slide guide groove 618 with which the slide guide portion 518 engages and a second slide guide groove 619 with which the slide guide member 519 engages. The first slide guide groove 618 and the second slide guide groove 619 extend in a longitudinal direction of the slide plate 61. A screw 6181 is fitted into a thread groove formed in the slide guide portion 518. A screw 6191 is fitted into a thread groove 5191 formed in the slide guide member 519. The slide plate 61 is attached to the rotatable stage 51 so as to be slidable in a predetermined direction by the screw 6181 and the screw 6191. The slide guide member 519 is a separate member from the rotatable stage 51 and is attached to the rotatable stage 51 by the screw 6191.

Furthermore, the slide plate 61 has an allowance groove 613 formed approximately at the center of the slide plate 61. The allowance groove 613 extends perpendicular to the first slide guide groove 618. The tip portion 4132 of the output pin 413 engages with the allowance groove 613. The allowance groove 613 allows the output pin 413 to move in a predetermined direction. With this configuration, the slide plate 61 slides in cooperation with movement of the output pin 413 within the predetermined range. Additionally, the slide plate 61 rotates in cooperation with rotation of the rotatable stage 51.

Now, operation of the driving mechanism 101 will be described below.

FIGS. 10A to 10F are transparent views showing sliding and rotation of the slide plate 61. The movable divisional segment is not illustrated in FIGS. 10A to 10F.

Figure 10A:
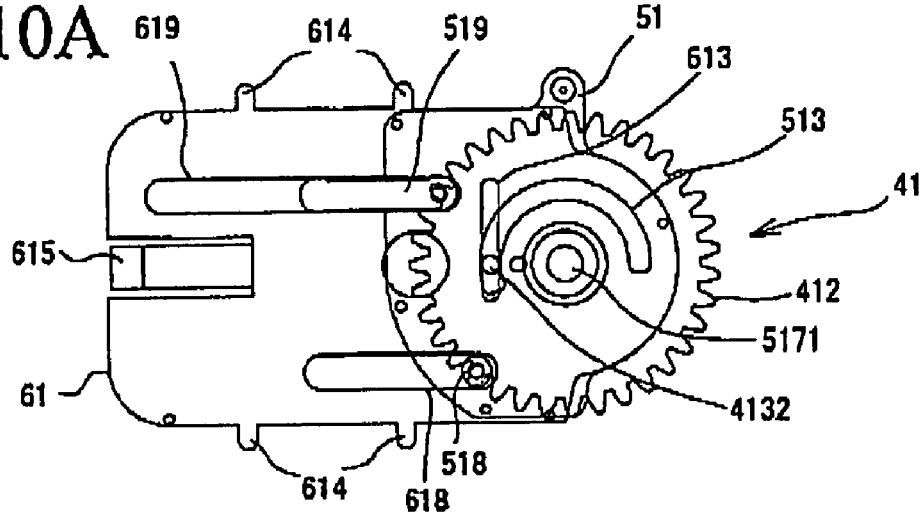
FIGS. 10A to 10F are transparent views showing sliding and rotation of a slide plate in the driving mechanism shown in FIG. 8.

FIG. 10A shows that the slide plate 61 is held at an initial position. At that time, the movable divisional segment 21 is held at the state shown in FIG. 1. In this state, the tip portion 4132 of the output pin 413 engages with the allowance groove 613 and the arcuate groove 513, thereby rotating the rotatable member 41 clockwise.

Figure 10B:
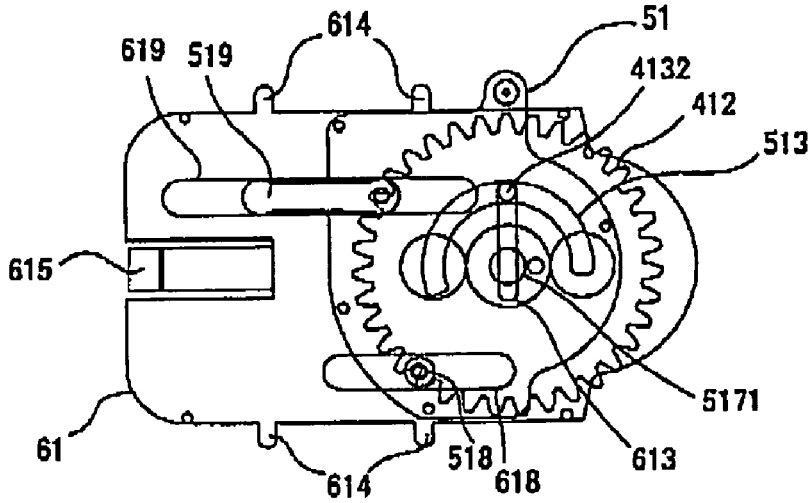

FIG. 10B shows that the rotatable member 41 is rotated clockwise through 90° from the state shown in FIG. 10A. At that time, the tip portion 4132 of the output pin 413 is located at an end of the allowance groove 613 and located at a central portion of the arcuate groove 513. When the output pin 413 is moved to the central portion of the arcuate groove 513, the slide plate 61 is slid in the rightward direction by the tip portion 4132 of the output pin 413. Furthermore, the slide guide portion 518 and the slide guide member 519 regulate a direction in which the slide plate 61 is slid. In this state, the rotatable stage 51 is not rotated.

Figure 10C:
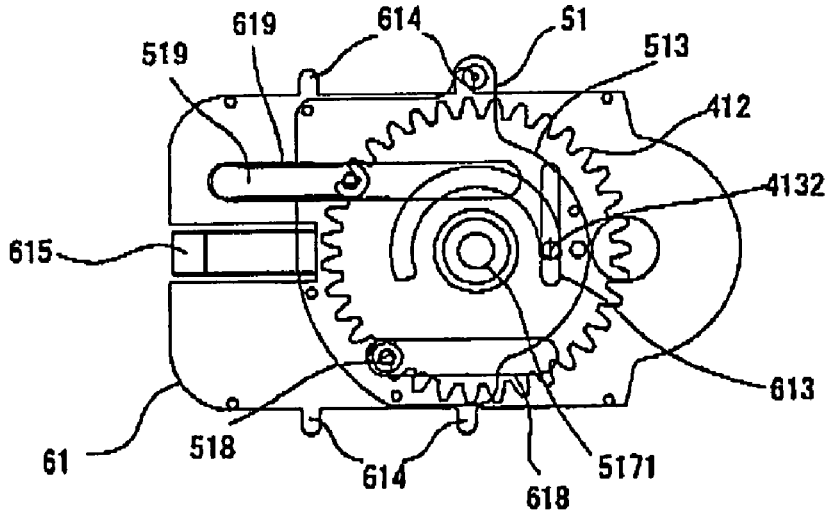

FIG. 10C shows that the rotatable member 41 is further rotated clockwise through 90° from the state shown in FIG. 10B. At that time, the tip portion 4132 of the output pin 413 is located at an end of the arcuate groove 513. The slide plate 61 is further slid in the rightward direction from the state shown in FIG. 10B by the movement of the output pin 413.

The movable divisional segment 21 is held at the state shown in FIG. 2. In this state, the rotatable stage 51 is not rotated.

Figure 10D:
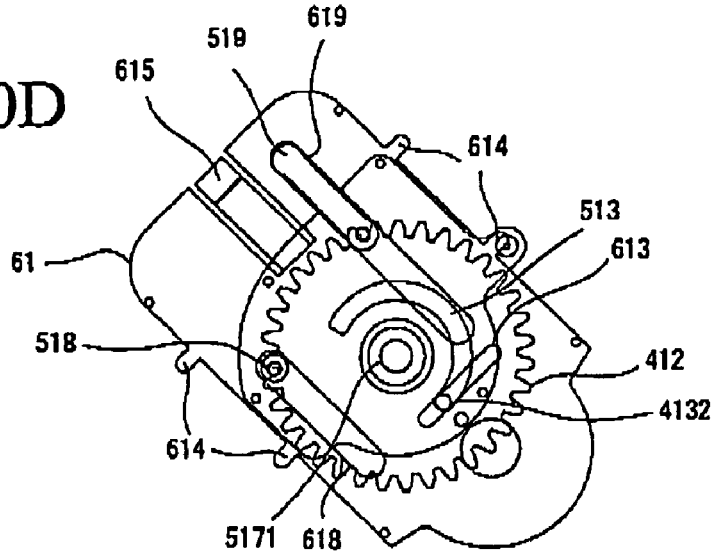

FIG. 10D shows that the rotatable member 41 is further rotated clockwise through 45° from the state shown in FIG. 10C. At that time, the rotatable stage 51 is rotated clockwise through 45° while the tip portion 4132 of the output pin 413 is located at the end of the arcuate groove 513. Furthermore, the slide plate 61 is also rotated clockwise through 45° in cooperation with the rotation of the rotatable stage 51. The movable divisional segment 21 is held at the state shown in FIG. 3.

Figure 10E:
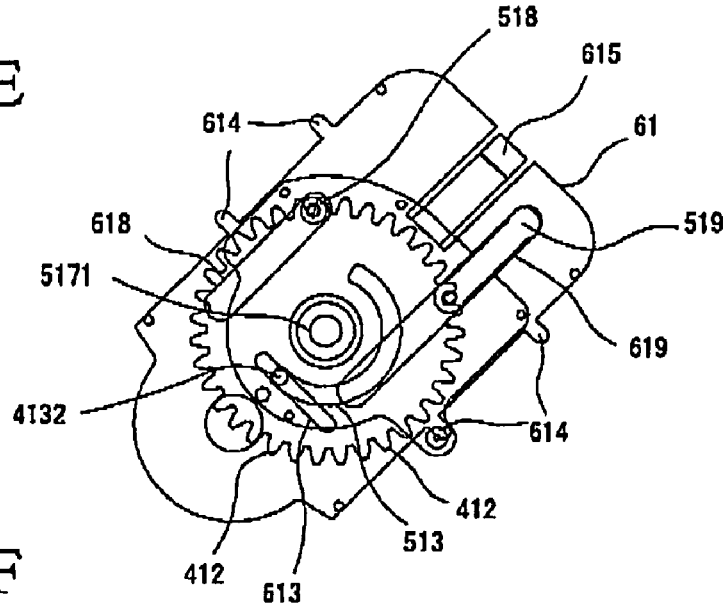

FIG. 10E shows that the rotatable member 41 is further rotated clockwise through 90° from the state shown in FIG. 10D while both of the rotatable stage 51 and the slide plate 61 are rotated as well.

Figure 10F:
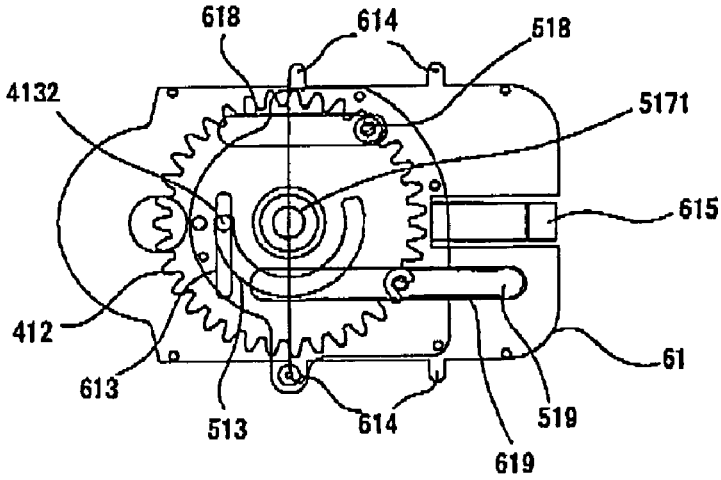

FIG. 10F shows that the rotatable member 41 is further rotated clockwise through 45° from the state shown in FIG. 10E. At that time, the movable divisional segment 21 is held at the state shown in FIG. 5.

With the above configuration, the movable divisional segment 21 can be moved outward and rotated by the rotation of the rotatable member 41.

In order to return from the state shown in FIG. 10F to the state shown in FIG. 10A, the rotatable member 41 is first rotated in a reverse direction from the state shown in FIG. 10F to the state shown in FIG. 10C. At that time, in accordance with the rotation of the rotatable member 41, the rotatable stage 51 and the slide plate 61 are rotated counterclockwise by the restoring force of the torsion spring 417. After the rotatable stage 51 returns to the initial position shown in FIG. 10C, the rotatable member 41 is rotated from the state shown in FIG. 10C to the state shown in FIG. 10A so that the movable divisional segment 21 returns to the initial position.

Next, the attachment of the movable divisional segment to the slide plate will be described in detail.

FIGS. 11A to 11D are views showing an arrangement of a slide plate in the driving mechanism shown in FIG. 8. FIG. 11A is a front view of the slide plate, FIG. 11B a cross-sectional view taken along line A-A of FIG. 11A, FIG. 11C a cross-sectional view taken along line B-B of FIG. 11A, and FIG. 11D a perspective view of the slide plate.

Figures 12A, 12B, 12C, 12D:
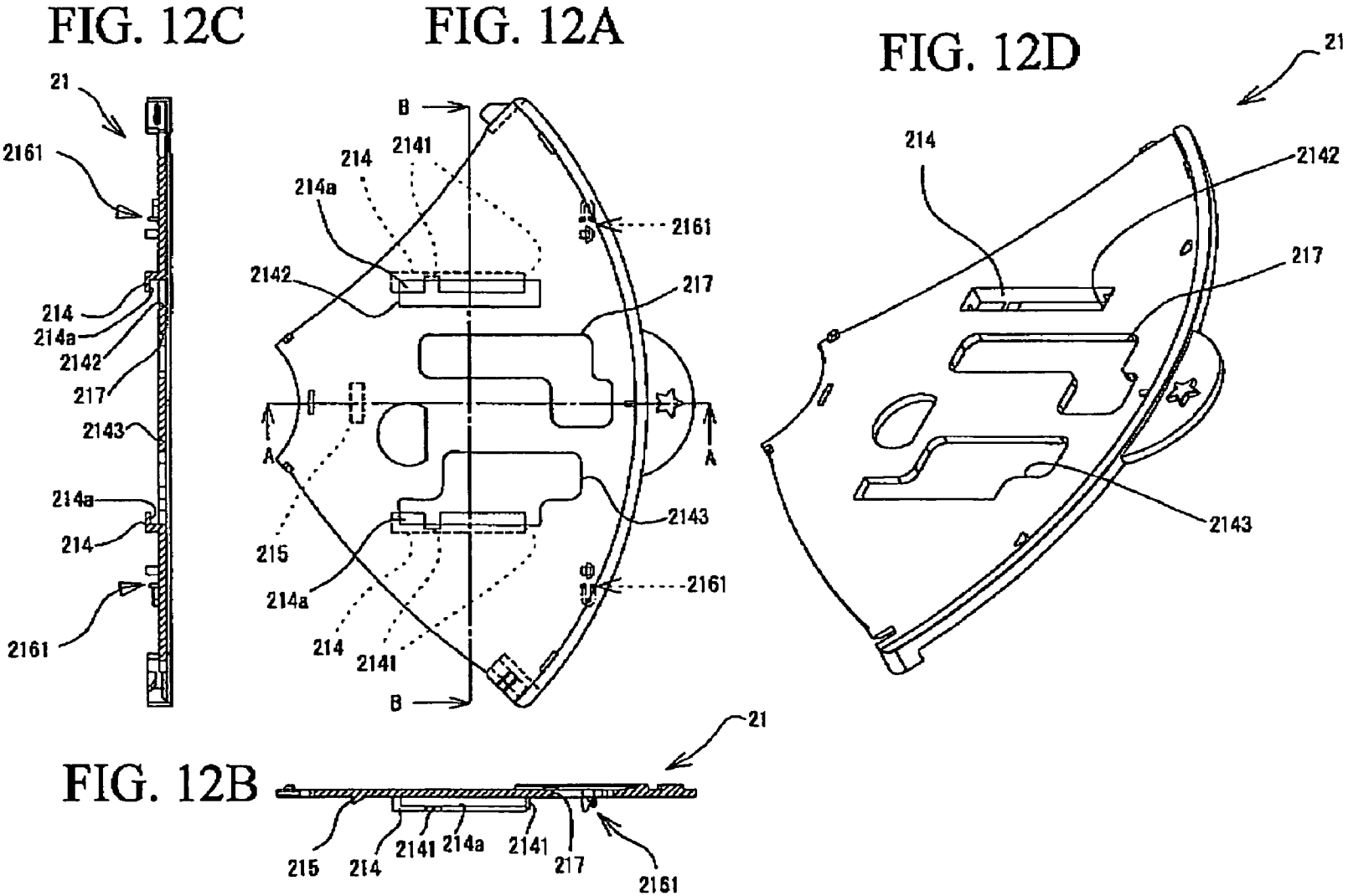
FIGS. 12A to 12D are views showing an arrangement of one of the movable divisional segments.

FIGS. 12A to 12D are views showing an arrangement of one of the movable divisional segments. FIG. 12A is a front view of the movable divisional segment, FIG. 12B a cross-sectional view taken along line A-A of FIG. 12A, FIG-12C a cross-sectional view taken along line B-B of FIG. 12A, and FIG. 12D a perspective view of the movable divisional segment.

As shown in FIGS. 11A to 11D, the slide plate 61 has protuberances (engagement portions) 614 projecting from side surfaces of the slide plate 61. Two protuberances 614 are formed at a predetermined interval on each of the side surfaces of the slide plate 61.

Each of the protuberances 614 has a hemispherical projection projecting in a direction perpendicular to the slide plate 61. The hemispherical projections provided on the protuberances 614 are brought into contact with rail surfaces of the movable divisional segment 21, which will be described later. Since the shape of the hemispherical projections can reduce frictional resistance, a sliding operation of the slide plate 61 can smoothly be performed.

Furthermore, the slide plate 61 has a projection 616 formed near the allowance groove 613 so as to extend perpendicular to the slide plate 61.

Moreover, the slide plate 61 has a snap-on hook (detachment prevention stopper or positioning stopper) 615 formed thereon. The protuberances 614, the projection 616, and the snap-on hook 615 are formed integrally with the slide plate 61.

As shown in FIGS. 12A to 12D, the movable divisional segment 21 has a pair of rail portions (holder members) 214 formed on a surface of the moveable divisional segment 21 facing the slide plate 61. Each of the rail portions 214 has an L-shaped cross-section. The rail portions 214 have tip portions opposed to each other and extend in parallel to the movable divisional segment 21. The rail portions 214 are formed integrally with the movable divisional segment 21. The rail portions 214 extend in a direction to which the movable divisional segment 21 is slid by the slide plate 61, i.e., a direction in which the movable divisional segment 21 is moved inward and outward. Each of the rail portions 214 has an inner surface 214*a* serving as a rail surface with which the aforementioned protuberances 614 are brought into sliding contact. The rail portions 214 are formed on the right and left sides of a center line passing through the center of the movable divisional segment 21 in parallel to a direction in which the movable divisional segment 21 is moved. The movable divisional segment 21 has opening portions 2142 and 2143 formed near the rail portions 214 along a direction in which the rail portions 214 extend. The opening portion 2143 is larger than the opening portion 2142.

Furthermore, each of the rail portions 214 has two notch portions 2141 formed therein. The two notch portions 2141 are formed at a predetermined interval so as to correspond to the two protuberances 614 formed on each side surface of the slide plate 61. The notch portions 2141 are used for paths of the protuberances 614 of the slide plate 61 between the rail portions 214 so as to detach the movable divisional segment 21 from the slide plate 61. The rail portions 214 are formed such that the protuberances 614 of the slide plate 61 can be brought into sliding contact with the rail portions 214.

Moreover, the movable divisional segment 21 has an abutment portion (detachment prevention stopper or positioning stopper) 215 formed thereon. The abutment portion 215 is formed on a surface of the movable divisional segment 21 facing the slide plate 61 so that the snap-on hook 615 of the slide plate 61 engages with the abutment portion 215.

Furthermore, the movable divisional segment 21 has attachment portions 2161 formed on the surface of the movable divisional segment 21 facing the slide plate 61. The attachment portions 2161 are used for attachment of a wire spring (biasing member) 216. The wire spring 216 is mounted perpendicular to a direction in which the movable divisional segment 21 is moved. The wire spring 216 is not illustrated in FIGS. 12A to 12D.

Each of the attachment portions 2161 for attachment of the wire spring 216 has a U-shaped closing portion for receiving both ends of the wire spring 216, thereby preventing detachment of the wire spring 216.

The rail portions 214, the abutment portion 215, the protuberances 614, and the snap-on hook 615 described above serve as an attachment structure for attachment of the movable divisional segment 21 to the slide plate 61. Furthermore, the movable divisional segment 21, the slide plate 61, and the attachment structure jointly form a movable unit operable to expose and hide the ornamental portion 30.

Next, a method of attaching the movable divisional segment 21 to the slide plate 61 will be described.

Figure 13A:
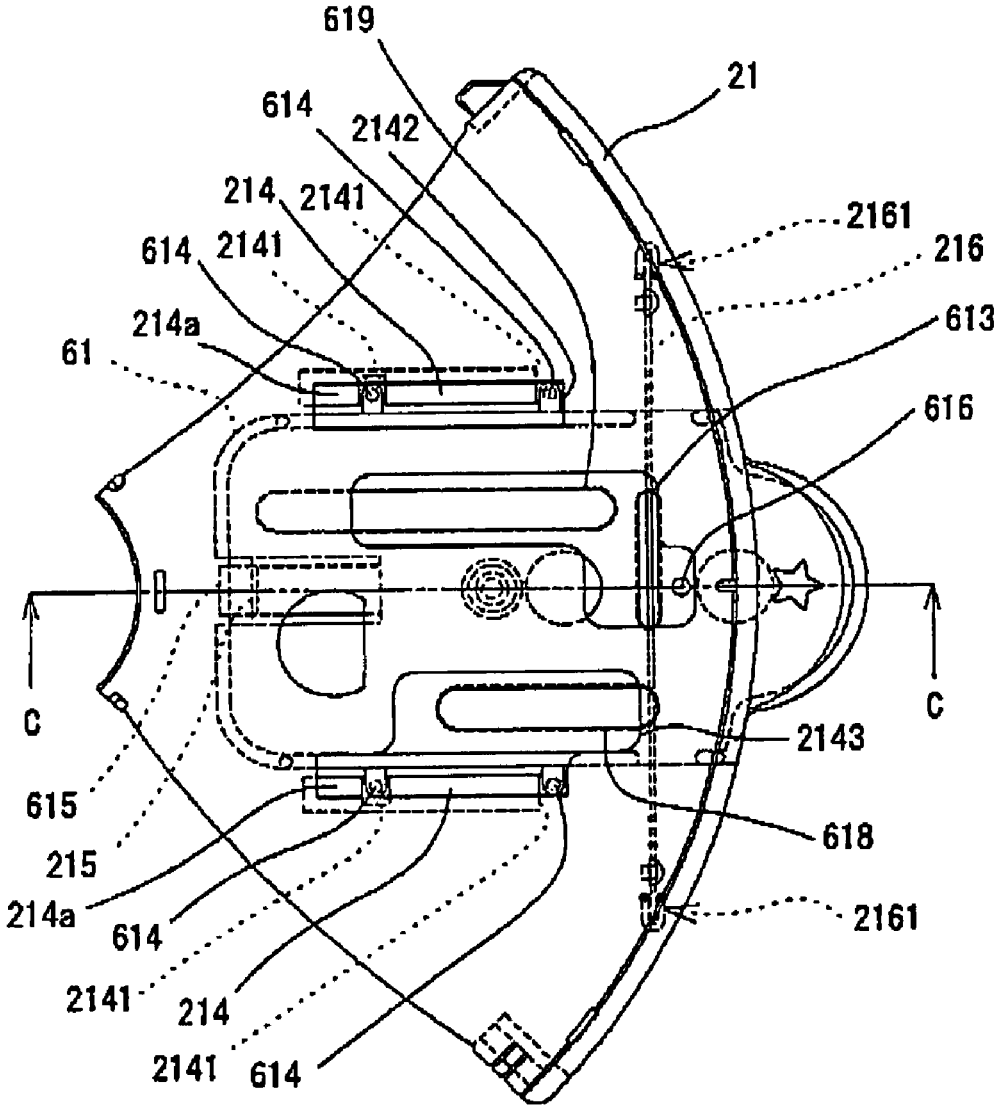
FIGS. 13A and 13B are views that protuberances of the slide plate are inserted into rail portions of the movable divisional segment.
Figure 13B:
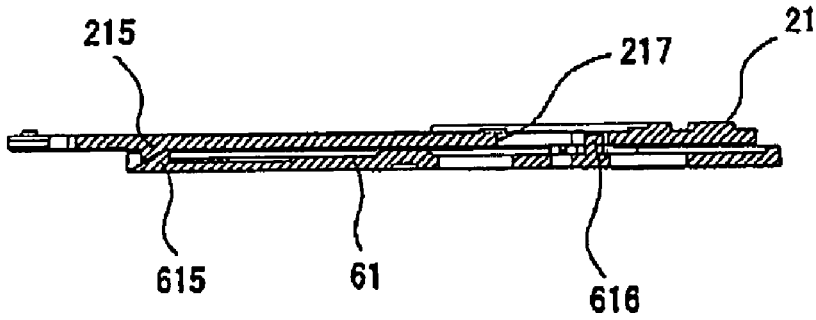
Figure 14C:
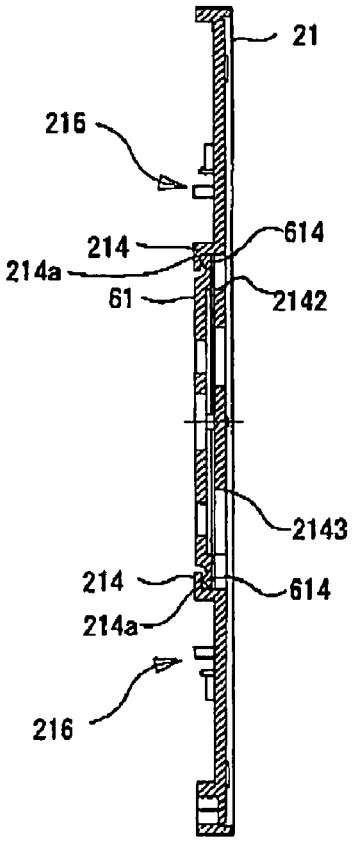
FIGS. 14A to 14C are views that the movable divisional segment is attached to the slide plate after the protuberances of the slide plate have been inserted into the rail portions of the movable divisional segment.
Figure 14A:
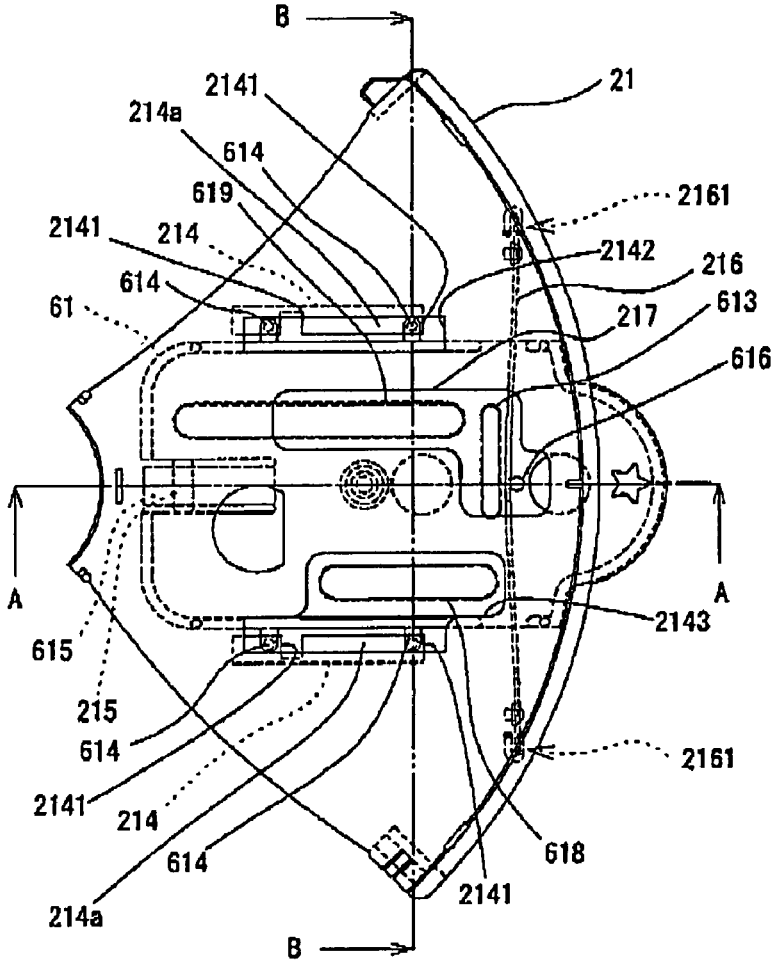
Figure 14B:
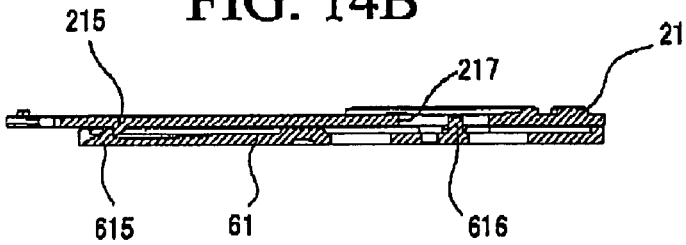

FIGS. 13A and 13B are views that the protuberances of the slide plate are inserted into the rail portions of the movable divisional segment. FIG. 13A is a front view, and FIG. 13B is a cross-sectional view taken along line C-C of FIG. 13A. FIGS. 14A to 14C are views that the movable divisional segment is attached to the slide plate after the protuberances of the slide plate have been inserted into the rail portions of the movable divisional segment. FIG. 14A is a front view, FIG. 14B is a cross-sectional view taken along line A-A of FIG. 14A, and FIG. 14C is a cross-sectional view taken along line B-B of FIG. 14A.

As shown in FIGS. 13A and 13B, the protuberances 614 of the slide plate 61 are inserted into the notch portions 2141, which are formed in the rail portions 214 of the movable divisional segment 21. At that time, an upper surface of the slide plate 61 is brought into contact with a lower surface of the movable divisional segment 21.

Then, in the state shown in FIGS. 13A and 13B, the slide plate 61 or the movable divisional segment 21 is pushed so that the protuberances 614 are located at retraction positions away from the notch portions 2141. At that time, as shown in FIGS. 14A to 14C, the protuberances 614 are moved away from the notch portions 2141 and received between the rail portions 214. When the protuberances 614 are received within the rail portions 214, the movable divisional segment 21 is attached to the slide plate 61.

Furthermore, as shown in FIGS. 14A to 14C, the snap-on hook 615 engages with the abutment portion 215. The engagement of the snap-on hook 615 and the abutment portion 215 regulates a relative movement between the slide plate 61 and the movable divisional segment 21 in a direction in which the rail portions 214 extend.

Moreover, in order to regulate a relative movement between the slide plate 61 and the movable divisional segment 21 in a direction opposite to the regulating aforementioned direction, the wire spring 216 biases the slide plate 61 and the movable divisional segment 21 toward the regulation direction of the snap-on hook 615 and the abutment portion 215.

As described above, the protuberances 614 are formed integrally with the slide plate 61, and the rail portions 214 are formed integrally with the movable divisional segment 21. Accordingly, no separate members are needed to attach the divisional segment to the slide plate. As a result, the number of parts can be reduced, and the divisional segment can readily be attached to the slide plate. Thus, the mechanical clock can readily be assembled.

Additionally, a pair of rail portions 214 having an L-shaped cross-section is formed so as to surround peripheral surfaces of the protuberances 614. Accordingly, looseness between the slide plate 61 and the movable divisional segment 21 can be prevented in the vertical direction and the direction in which the rail portions 214 extend. Thus, it is possible to maintain an accuracy of attachment of the movable divisional segment 21 to the slide plate 61.

Specifically, the hemispherical projections of the protuberances 614 are brought into contact with the rail surfaces 214*a* of the rail portions 214. Thus, the upper surface of the slide plate 61 is brought into contact with the lower surface of the movable divisional segment 21. Accordingly, it is possible to prevent looseness between the slide plate 61 and the movable divisional segment 21 in the vertical direction. Furthermore, the side surfaces of the protuberances 614 are brought into contact with the inner surfaces of the rail portions 214. Therefore, it is possible to prevent looseness in the direction in which the rail portions 214 extend and in the vertical direction.

Furthermore, as described above, when the slide plate 61 or the movable divisional segment 21 is pushed so that the protuberances 614 inserted between the rail portions 214 are moved toward the retraction positions away from the notch portions 2141, the snap-on hook 615 finally engages with the abutment portion 215. The engagement of the snap-on hook 615 and the abutment portion 215 prevents the protuberances 614 from coming off the notch portions 2141 after the movable divisional segment 21 has been attached to the slide plate 61.

As described above, the wire spring 216 biases the slide plate 61 and the movable divisional segment 21 towards the aforementioned regulation direction of the snap-on hook 615 and the abutment portion 215 in order to regulate a relative movement between the slide plate 61 and the movable divisional segment 21 in the direction opposite to the regulation direction.

Specifically, when the movable divisional segment 21 is to be attached to the slide plate 61, the projection 616 is brought into contact with a central portion of the wire spring 216. Thus, the wire spring 216 applies a biasing force to the slide plate 61 and the movable divisional segment 21. It is noted that the wire spring 216 applies such a biasing force that the snap-on hook 615 does not disengage from the abutment portion 215.

With the above arrangement, it is possible to regulate a relative movement in the direction opposite to the regulation direction. Accordingly, the movable divisional segment 21 can reliably be positioned with respect to the slide plate 61.

Thus, the movable divisional segment 21 can readily be attached to the slide plate 61 simply by pushing the slide plate 61 or the movable divisional segment 21 so that the protuberances 614 inserted between the rail portions 214 are moved toward the retraction positions away from the notch portions 2141. Furthermore, with this configuration, the movable divisional segment 21 can also be detached readily from the slide plate 61.

Next, the slide plate 61 and the movable divisional segment 21 at the time when a plurality of movable divisional segments 21 to 24 are moved inward and outward will be described below.

For example, when the movable divisional segments 21 to 24 are to be moved from the state shown in FIG. 2 to the state shown in FIG. 1, the movable divisional segments 21 to 24 are first brought into contact with the fixed divisional segment 25, then brought into contact with edges of adjacent movable divisional segments, and moved to the state shown in FIG. 1.

In the state shown in FIG. 1, each of the movable divisional segments 21 to 24 are at a closed position. However, the slide plates 61 are slightly moved relative to the movable divisional segments 21 to 24 toward the fixed divisional segment by a driving force from the rotatable stage 51 and the rotatable member 41. This is because the rail portions 214, the protuberances 614, the snap-on hook 615, and the abutment portion 215 form a clearance between a stop position of the movable divisional segment 21 and a stop position of the slide plate 61 so as to allow a relative movement between the slide plate 61 and the movable divisional segment 21.

Figure 15:
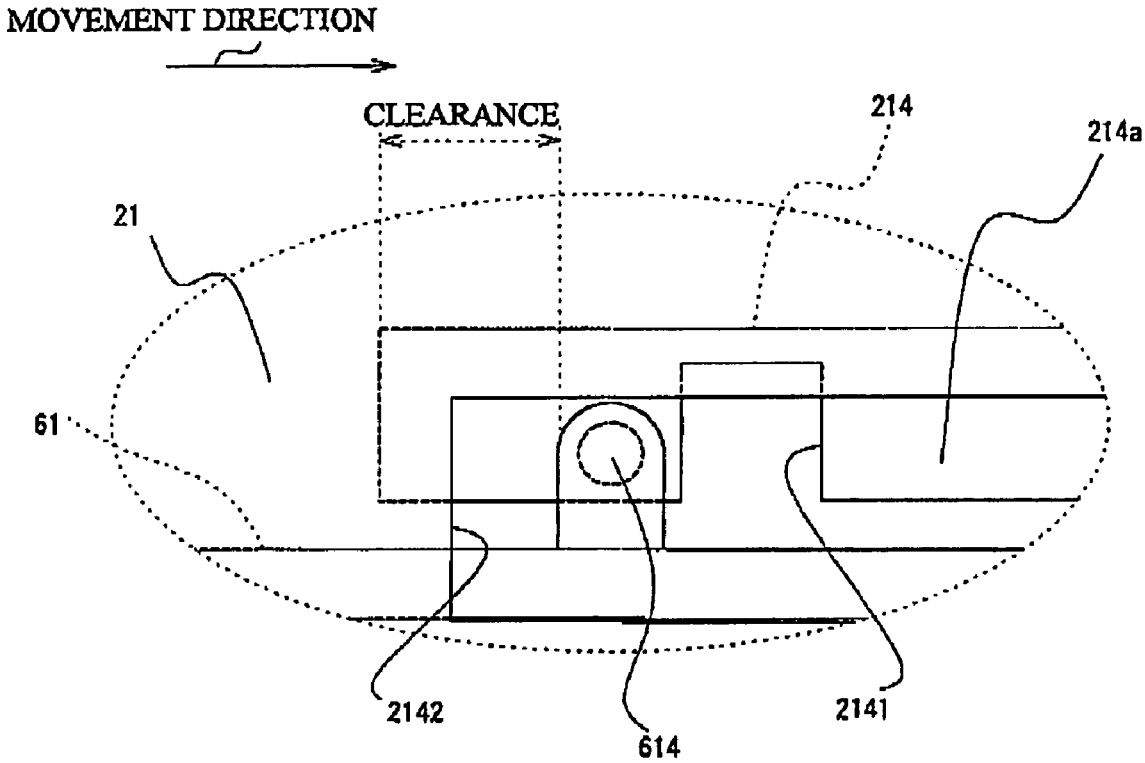
FIG. 15 is an enlarged view explanatory of a clearance between the slide plate and the movable divisional segment.

FIG. 15 is an enlarged view explanatory of the clearance between the slide plate 61 and the movable divisional segment 21.

As shown in FIG. 15, even though the movable divisional segment 21 is attached to the slide plate 61, the rail portions 214 maintains a clearance for allowing a relative movement of the movable divisional segment 21 in the direction opposite to the regulation direction of the snap-on hook 615 and the abutment portion 215.

Furthermore, when a plurality of movable divisional segments 21 to 24 are to be moved, this clearance allows the movable divisional segment 21 to be stopped at a predetermined position and then causes the slide plate 61 to be moved in a direction opposite to the movement direction of the movable divisional segment 21 (a direction opposite to the regulation direction of the snap-on hook 615 and the abutment portion 215) and to be stopped at a predetermined position. At that time, the projection 616 of the slide plate 61 further presses the wire spring 216 toward the direction opposite to the movement direction of the movable divisional segment 21. Thus, the wire spring 216 biases the movable divisional segment 21 toward the direction opposite to the movement direction of the movable divisional segment 21 with an increased biasing force.

With this configuration, the movable divisional segments 21 to 24 are further biased in the direction opposite to their movement directions in a state in which they are at closed positions. Accordingly, gaps are prevented from being produced between the adjacent movable divisional segments 21 to 24 when the movable divisional segments 21 to 24 are at the closed positions. Thus, it is possible to reliably hold the movable divisional segments 21 to 24 in a closed state.

Furthermore, the wire spring 216 has a function of biasing a stopper for positioning of the movable divisional segment 21 with respect to the slide plate 61. The wire spring 216 also has a function of biasing the movable divisional segment for reliably holding the movable divisional segment in a closed state. Thus, the single wire spring 216 has a plurality of functions. Accordingly, it is possible to simplify parts required for a mechanical clock.

Although a certain preferred embodiment of the present invention has been shown and described in detail, the present invention is not limited to the illustrated specific embodiment. It should be understood that various changes and modifications may be made therein without departing from the scope of the appended claims.

In the above embodiment, the dial is divided into the four movable divisional segments. However, the present invention is not limited to such an arrangement. For example, the dial may be divided into three movable divisional segments. Alternatively, the dial may be divided into four or more movable divisional segments.

In the above embodiment, the snap-on hook 615 and the abutment portion 215 have both of a stopper biasing function and a movement prevention biasing function. However, the present invention is not limited to such an arrangement. For example, snap-on hooks and abutment portions having each of the above functions may be provided separately.

The present invention is based on Japanese Patent Application No. 2006-156629 filed Jun. 5, 2006, the entire disclosure of which is hereby incorporated by reference.

What is claimed is:

1. A mechanical timepiece comprising;

an ornamental portion; and a plurality of movable units operable to expose and hide said ornamental portion, each of said plurality of movable units including:

i) a divisional segment for exposing and hiding said ornamental portion by inward and outward movement;

ii) a holding plate configured to hold said divisional segment in a movable manner so as to move said divisional segment in inward and outward directions; and iii) an attachment structure for attaching said divisional segment to said holding plate, said attachment structure being formed integrally with at least one of said holding plate and said divisional segment, said attachment structure including:

a) engagement portions projecting from both sides of said holding plate, and b) a pair of holder members formed on a surface of said divisional segment so as to have an L-shaped cross-section with their tip portions being opposed to each other, said pair of holder members extending in a predetermined direction so as to sandwich peripheral surfaces of said engagement portions therebetween.

2. The mechanical timepiece as recited in claim 1, wherein said pair of holder members have notch portions for allowing said engagement portions to pass therethrough from between said pair of holder members so as to detach said divisional segment from said holding plate, wherein said divisional segment is attached to said holding plate by pushing said holding plate or said divisional segment so that said engagement portions inserted between said pair of holder members are moved toward retraction positions away from said notch portions.

3. The mechanical timepiece as recited in claim 2, wherein said attachment structure further includes a stopper configured to regulate a relative movement between said holding plate and said divisional segment in a regulation direction from the retraction positions to said notch portions so as to prevent detachment of said engagement portions from said notch portions after said divisional segment has been attached to said holding plate.

4. The mechanical timepiece as recited in claim 3, wherein each of said plurality of movable units further includes a biasing member configured to bias at least one of said holding plate and said divisional segment in the regulation direction so as to regulate a relative movement between said holing plate and said divisional segment in a direction opposite to the regulation direction.

5. The mechanical timepiece as recited in claim 1, wherein said attachment structure has a clearance between a stop position of said divisional segment to a stop position of said holding plate for allowing a relative movement between said holding plate and said divisional segment when said divisional segment is moved, wherein each of said plurality of movable units further includes a biasing member configured to bias said divisional segment in a direction opposite to a direction in which said divisional segment is moved in a state such that said holding plate is fixed.

6. The mechanical timepiece as recited in claim 5, wherein said attachment structure further includes a stopper configured to regulate a relative movement between said holding plate and said divisional segment in a regulation direction from the retraction positions to said notch portions so as to prevent detachment of said engagement portions from said notch portions after said divisional segment has been attached to said holding plate, wherein said biasing member also serves to bias at least one of said holding plate and said divisional segment in the regulation direction so as to regulate a relative movement between said holing plate and said divisional segment in a direction opposite to the regulation direction.

* * * * *